US006397945B1

(12) United States Patent
Manke et al.

(10) Patent No.: US 6,397,945 B1
(45) Date of Patent: Jun. 4, 2002

(54) POWER CABLE SYSTEM FOR USE IN HIGH TEMPERATURE WELLBORE APPLICATIONS

(75) Inventors: Gregory H. Manke, Overland Park; Marcus D. McHugh; Howard A. Oswald, both of Lawrence, all of KS (US)

(73) Assignee: Camco International, Inc., Houston, TX (US)

( * ) Notice: Subject to any disclaimer, the term of this patent is extended or adjusted under 35 U.S.C. 154(b) by 0 days.

(21) Appl. No.: 09/549,502

(22) Filed: Apr. 14, 2000

(51) Int. Cl.[7] ..... E21B 23/00
(52) U.S. Cl. ..... 166/65.1; 166/68.5; 166/105
(58) Field of Search ..... 166/65.1, 68, 68.5, 166/108

(56) References Cited

U.S. PATENT DOCUMENTS 4,572,299 A * 2/1986 Vanegmond et al. ..... 166/385
4,665,281 A * 5/1987 Kamis ..... 174/102 R
5,146,982 A * 9/1992 Dinkins ..... 166/65.1
5,148,864 A * 9/1992 Willis et al. ..... 166/65.1
5,384,430 A 1/1995 Anthony et al.

FOREIGN PATENT DOCUMENTS

GB 2190782 A 11/1987
GB 2325483 A 11/1998
GB 2334284 A 8/1999

* cited by examiner

*Primary Examiner*—William Neuder
(74) *Attorney, Agent, or Firm*—Fletcher, Yoder & Van Someren

(57) ABSTRACT

A submersible pumping system for use in high temperature, wellbore applications. The system includes an electric submersible pumping unit, having at least a submersible motor, a motor protector and a submersible pump powered by the submersible motor. A uniquely designed power cable is coupled to the submersible motor to provide power thereto. The unique design of the power cable and its connector permit the use of the overall system in high temperature environments or applications where the system is exposed to high temperature conditions.

22 Claims, 4 Drawing Sheets

FIG. 2
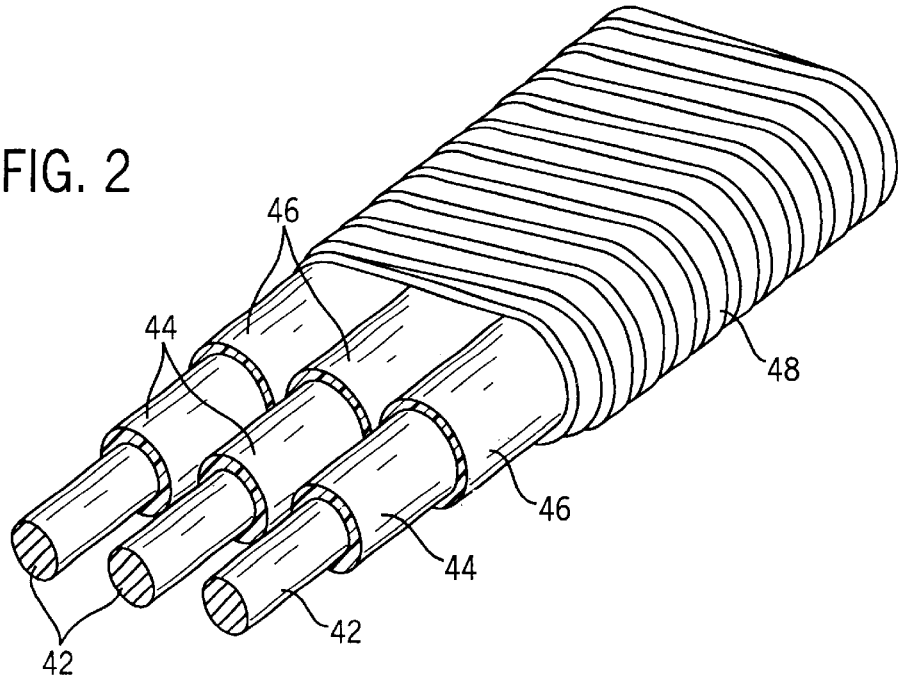
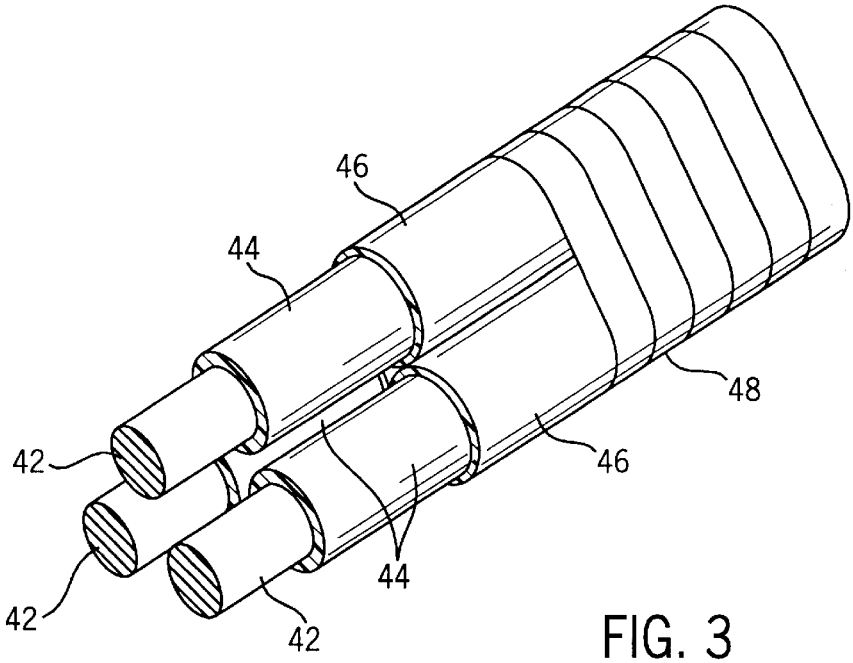
FIG. 3

POWER CABLE SYSTEM FOR USE IN HIGH TEMPERATURE WELLBORE APPLICATIONS

FIELD OF THE INVENTION

The present invention relates generally to power cable, and particularly to a power cable system designed in conjunction with submersible pumping systems that are used in extremely high temperature, wellbore environments.

BACKGROUND OF THE INVENTION

Submersible pumping systems are used in a wide variety of environments. An exemplary application includes the use of an electric submersible pumping system disposed within a wellbore for pumping a production fluid, such as petroleum. The electric submersible pumping system includes, among other components, a submersible motor that powers a submersible pump. The submersible pumping system is deployed on a deployment system, such as coil tubing or production tubing, and power is provided to the submersible motor by a power cable disposed along or inside the deployment system.

Sometimes, it is desirable to utilize submersible pumping systems in high temperature applications. High temperature applications, for example, occur in wells subject to steam floods and low to no-flow conditions. Production fluid recovery in such areas can expose the submersible pumping system, including the power cable, to temperatures exceeding 600° Fahrenheit and up to or over 1,0000° Fahrenheit.

One problem with existing systems is the inability of power cables and power cable connections to withstand such high temperatures. Typically, a conventional power cable and the connector, i.e. pothead, utilized to couple the power cable to the electric motor is limited to a maximum temperature of approximately 450° Fahrenheit. Temperatures exceeding this level lead to degradation of the cable and connector materials. The degradation often can lead to power cable failure.

Previous attempts to adapt submersible pumping systems to high temperature environments have focused on the use of new elastomers in both cable and connector design. To date, however, such attempts have not resulted in a system able to withstand high temperature applications, herein defined as applications in which the power cable and/or connector are exposed to temperatures exceeding 450° Fahrenheit.

It would be advantageous to create a submersible pumping system for application in high temperature environments.

SUMMARY OF THE INVENTION

The present invention features a submersible pumping system that may be deployed in a wellbore to pump a fluid disposed in a subterranean formation. The system includes an electric submersible pumping system having a motor and a pump powered by the motor. Additionally, a deployment system is coupled to the electric submersible pumping system to deploy it within the wellbore. A power cable is disposed along the deployment system and connected to the motor to provide power thereto. The power cable includes at least three conductors that are individually protected by a mineral insulation layer and a metallic sheath layer.

According to another aspect of the present invention, a power cable is provided for use in a subterranean environment. The power cable includes a plurality of conductors and a layer of insulation disposed about each of the conductors. A metallic sheath also is disposed about each conductor, and an armor layer encloses the plurality of conductors collectively. Additionally, a metallic connector of the type adapted for connection to a submersible motor is connected to the plurality of conductors. Specifically, each metallic sheath is coupled to and sealed to the metallic connector via a metal-to-metal connection.

According to another aspect of the present invention, a submersible system is designed for use in a subterranean environment. The system includes a power cable and a submersible motor. The power cable has a plurality of conductors capable of carrying three-phase power. A layer of insulation is disposed about each of the conductors, and a metal sheath jackets each layer of insulation. An armor is disposed about the plurality of conductors. At an end of the armor, a connector forms a metal-to-metal seal with the metal sheath about each conductor. The connector is designed for engagement with the submersible motor.

BRIEF DESCRIPTION OF THE DRAWINGS

The invention will hereafter be described with reference to the accompanying drawings, wherein like reference numerals denote like elements, and:

FIG. 2 is a perspective view of an exemplary power cable utilized in the present invention;

FIG. 3 is a perspective view of an alternate embodiment of the power cable illustrated in FIG. 2;

DETAILED DESCRIPTION OF THE PREFERRED EMBODIMENT

Figure 1:
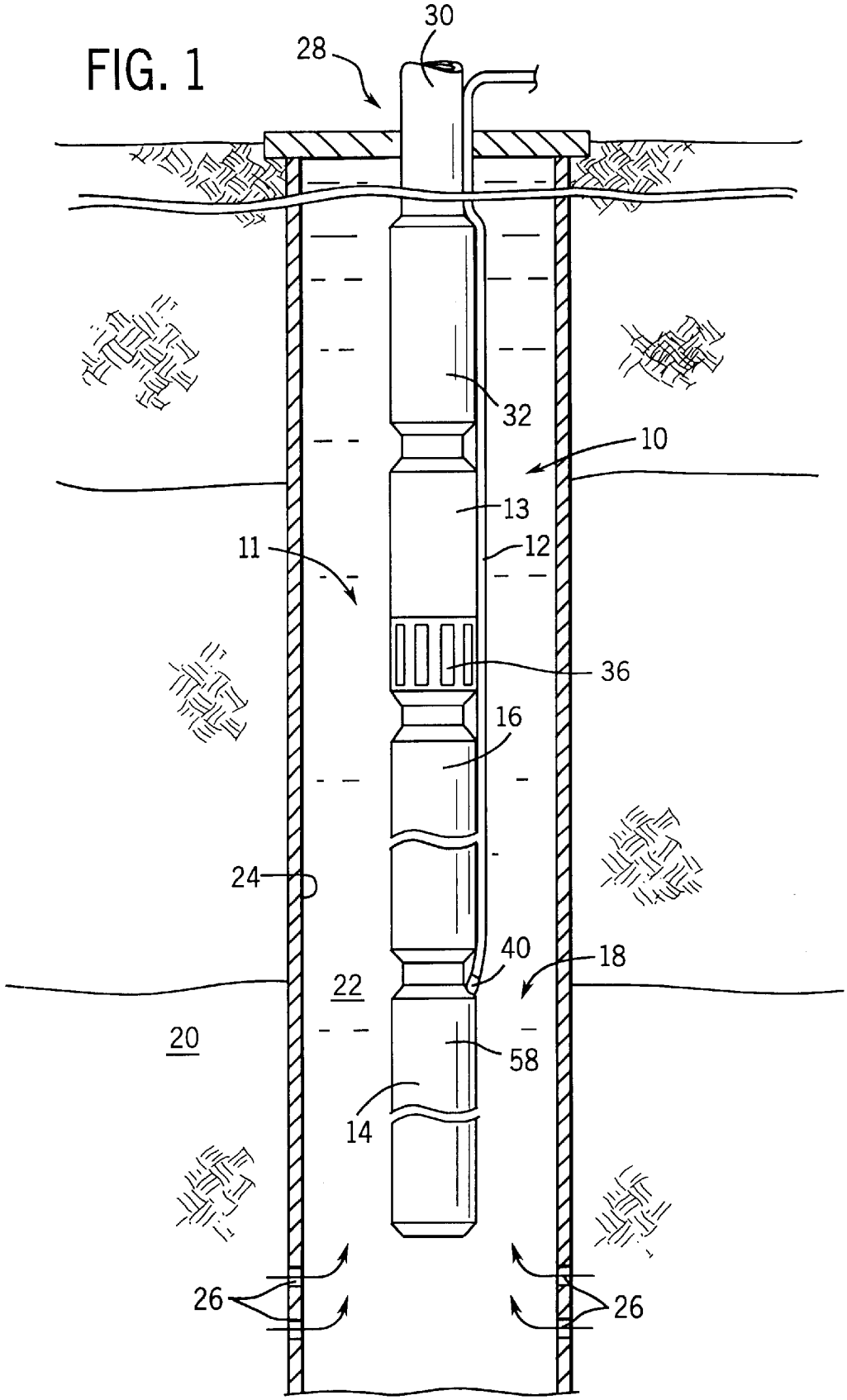
FIG. 1 is a front elevational view of a submersible system, according to a preferred embodiment of the present invention.

Referring generally to FIG. 1, an exemplary system 10 is illustrated according to a preferred embodiment of the present invention. System 10 may have a variety of forms and configurations, but generally includes a downhole appliance 11 powered by a power cable 12 able to withstand high temperature environments and/or conditions. High temperature environments refer to environments in which the system 10 or portions of system 10 are subjected to heat in excess of 450° Fahrenheit. Sometimes, the high heat environments can exceed 600° Fahrenheit up to or beyond approximately 1,000° Fahrenheit.

One exemplary downhole appliance 11 comprises an electric submersible pumping system that may have a variety of components, depending on the particular application or environment in which it is used. Typically, however, the electric submersible pumping system includes at least a submersible pump 13, a submersible motor 14 and a motor protector 16.

In the specific example illustrated, system 10 is designed for deployment in a well 18 within a geological formation 20 containing desirable production fluids, such as petroleum. A wellbore 22 typically is drilled and lined with a wellbore casing 24. Wellbore casing 24 includes a plurality of openings or perforations 26 through which production fluids flow from formation 20 into wellbore 22. In some applications, system 10 or components of system 10 operate in a high heat environment or under high heat conditions. For example, steam floods or low to no-flow conditions can result in such high heat operation that would be detrimental to a conventional system. Additionally, the reservoir itself or additional power/current supplied through power cable 12 can create high heat conditions. In fact, the high heat capacity of power cable 12 and system 10 allows the system to handle more power without experiencing the damage that would occur in a conventional system.

Furthermore, the exemplary system 10 is deployed in wellbore 22 by a deployment system 28 that may have a variety of forms and configurations. For example, deployment system 28 may comprise tubing, such as coil tubing or production tubing, connected to pump 13 by a connector 32. Power is provided to submersible motor 14 by power cable 12. Submersible motor 14, in turn, powers pump 13 which draws production fluid into the pumping system through a pump intake 36. The fluid is produced or moved to the surface or other destination via tubing 30. However, in other applications, the production fluid is produced through the annulus intermediate deployment system 30 and wellbore casing 24.

It should be noted that the illustrated system 10 is merely an exemplary embodiment. Other components can be added or substituted, and other deployment systems may be implemented. Additionally, a variety of production fluids may be pumped to the surface or to other desired locations. In any of these configurations, the unique design of power cable 12 and its coupling to downhole appliance 11 permit the use of such systems in high temperature environments that would otherwise be prohibitive.

Power cable 12 is a high temperature cable coupled to submersible motor 14 at a connector 40, sometimes referred to as a pothead. Connector 40, like power cable 12, is designed to withstand high temperature environments.

Two exemplary alternate embodiments of power cable 12 are illustrated in FIGS. 2 and 3. However, a variety of other arrangements or configurations may be utilized.

In the examples illustrated, a plurality of conductors 42, such as copper conductors, are utilized. Three conductors 42 are illustrated for carrying three-phase power, but the number of conductors can be adapted for the specific application.

An insulating material 44 is disposed about each individual conductor 42. The insulating material 44 preferably forms a layer about each conductor and is able to withstand high heat conditions or environments. An exemplary insulating material is a mineral insulation, such as magnesium oxide insulation. The insulating material 44 disposed about each conductor 42 is surrounded, in turn, by a sheath 46. Typically, each sheath 46 is formed as an individual layer about each layer of insulating material 44. Sheath 46 preferably is a metallic sheath formed from, for example, stainless steel or Inconel™.

A layer of armor 48 is disposed about the group of conductors 42, insulating materials 44 and metallic sheaths 46 collectively. Preferably, armor 48 is a metallic armor, and it may be applied as, for example, a helically wrapped metallic armor, as is known to those of ordinary skill in the art. Conductors 42 and armor 48 may be arranged in a variety of configurations, including the generally flat configuration of FIG. 2 in which conductors 42 are generally aligned and the generally triangular configuration illustrated in FIG. 3.

Figure 4:
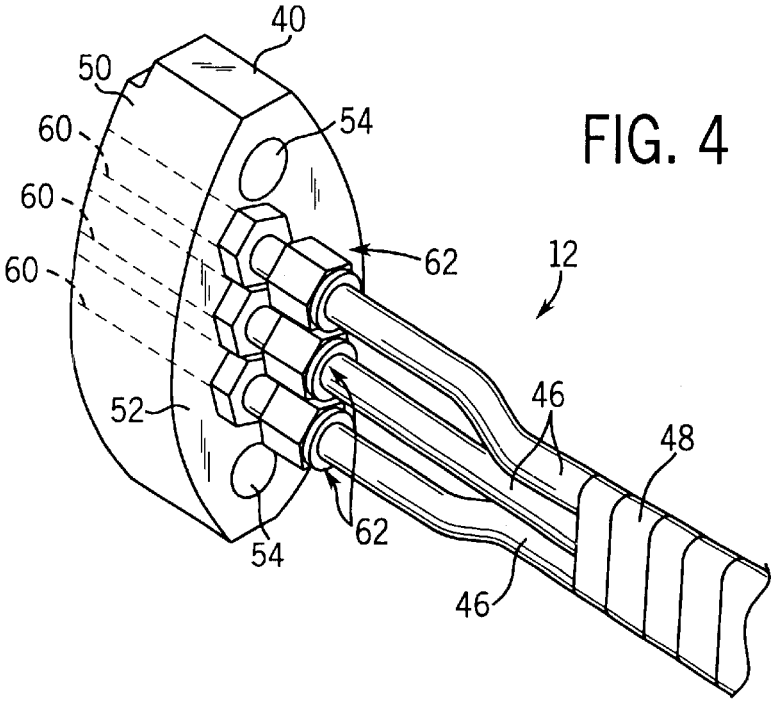
FIG. 4 is a perspective view of a power cable connector utilized in forming a connection between the power cable and a submersible motor.

Referring generally to FIG. 4, an enlarged perspective view of one embodiment of power cable 12 including connector 40 is illustrated. In this embodiment, connector 40 includes a motor housing attachment end 50 and a conductor attachment end 52 generally opposite end 50. In the exemplary embodiment, attachment end 50 is of a conventional configuration designed for engagement with the housing of a submersible motor, as known to those of ordinary skill in the art. A plurality of openings 54, e.g. two openings, may be formed through connector 40 to accommodate conventional fasteners (not shown) for securing connector 40 to an outer housing 58 (see FIG. 1) of submersible motor 14.

Typically, conductors 42 extend through corresponding openings 60 disposed in connector 40, and as illustrated by dashed lines in FIG. 4. The conductors 42 may thus be appropriately connected with submersible motor 14 inside outer housing 58, as with conventional power cables.

Typically, the insulating material and metallic sheath surrounding each conductor 42 also extend at least partially into connector 40 and may extend through connector 40. Each metallic sheath 46 is securely and sealingly attached to connector 40. Preferably, the connection is a metal-to-metal connection. In the embodiment illustrated in FIG. 4, each metallic sheath 46 is coupled to connector 40 by a tube fitting 62, such as a Swagelok™ tube fitting.

Figure 5:
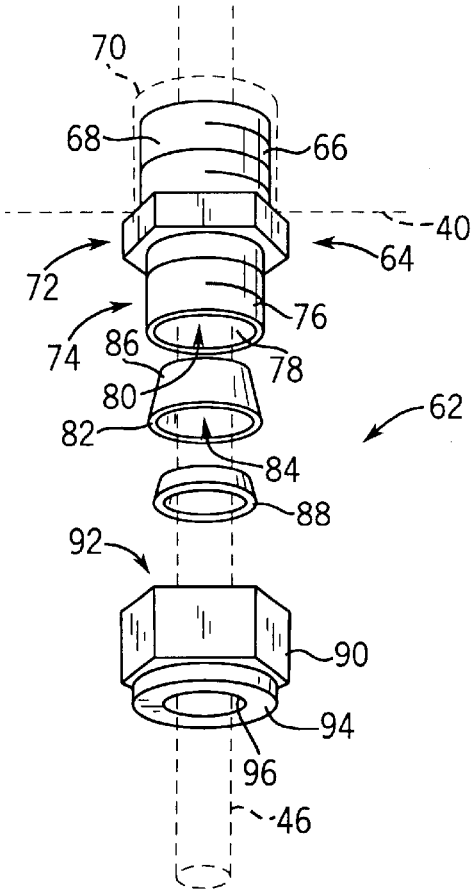
FIG. 5 is a perspective view of an exemplary coupling link used to affix an individual conductor with respect to the connector end of the power cable.

As further illustrated in FIG. 5, each tube fitting 62 includes a body portion 64 having an attachment end 66 designed for attachment to connector 40. For example, attachment end 66 may include a threaded region 68 designed for threaded engagement with a corresponding threaded region 70 (shown schematically by dashed lines in FIG. 5) of the corresponding opening 60.

Furthermore, body portion 64 includes a torque application region 72 that typically includes a hexagonal configuration designed for engagement by an appropriate wrench. This permits threaded region 68 to be turned into and tightened within corresponding threaded region 70.

Body portion 64 also includes a coupling end 74 that extends generally in the axially, opposite direction from torque application region 72. Coupling end 74 includes external threads 76 and an internal tapered region 78. Tapered region 78 tapers radially inward to a longitudinal opening 80 that extends through coupling end 74, torque application region 72 and attachment end 66. Opening 80 is preferably sized to receive a conductor 42 and corresponding metallic sheath 46 therethrough.

Tubing fitting 62 also includes a front ferrule 82 having a longitudinal opening 84 extending therethrough. Front ferrule 82 also includes a tapered external surface 86 designed for mating engagement with tapered region 78. A back ferrule 88 is designed to engage front ferrule 82 opposite tapered exterior surface 86.

A nut 90 is sized to fit over back ferrule 88 and front ferrule 82 for engagement with threads 76 of coupling end 74. Nut 90 includes an internal threaded region 92 configured to securely engage thread 76. Additionally, nut 90 includes an abutment end 94 having a central opening 96. Opening 96 is sized to permit the passage of one of the metallic sheaths 46 without permitting the passage of back ferrule 88. Thus, as nut 90 is tightened over coupling end 74, back ferrule 88 is forced against front ferrule 82. This moves the tapered exterior surface 86 against internal tapered region 78 of coupling end 74. As the nut 90 is continually tightened, ferrule 82 is forced inwardly along tapered region 78 until front ferrule 82 forms a solid metal-to-metal seal between metal sheath 46 and coupling end 74.

Figure 6:
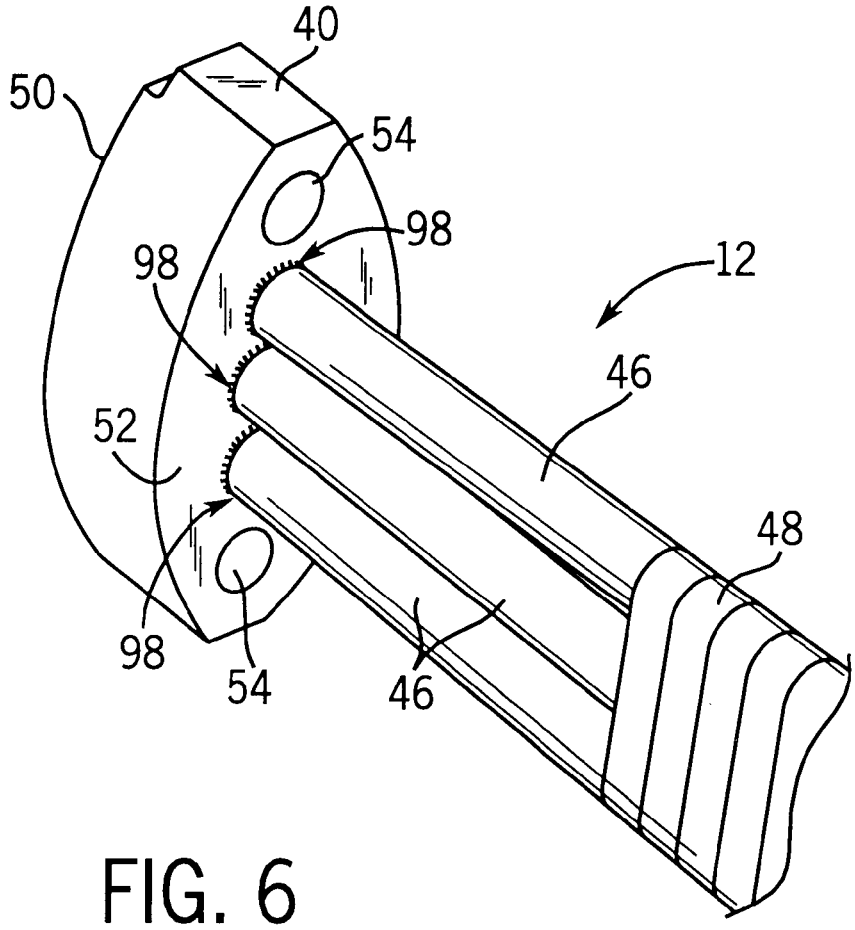
FIG. 6 is a perspective view of an alternate embodiment of the system illustrated in FIG. 4.

An alternate method for coupling connector 40 and conductors 42 is illustrated in FIG. 6. As described with reference to FIG. 4, each conductor along with its corresponding insulating material layer 44 and metallic sheath 46 is inserted into, and preferably through connector 40 via corresponding openings 60. In this embodiment, however, each metallic sheath 46 is sealingly affixed to connector 40 by a weld 98. By way of example, both connector 40 and metallic sheath 46 may be made of a material, such as Inconel™ or stainless steel. If stainless steel is used, each weld 98 is formed as an appropriate stainless steel weld.

As with the configuration illustrated in FIG. 4, a solid metal-to-metal connection and seal is formed between the metallic sheaths surrounding each conductor and connector 40. This permits power cable 12 and its associated downhole appliance to be used in extremely high temperature environments.

It will be understood that the foregoing description is of preferred exemplary embodiments of this invention, and that the invention is not limited to the specific forms shown. For example, the number of conductors, types of insulating material, design of the armor, and the types of metal can be altered according to the specific application. Additionally, downhole appliances other than electric submersible pumping systems may be combined with the heat tolerant power cable to meet the requirements of various applications. These and other modifications may be made in the design and arrangement of the elements without departing from the scope of the invention as expressed in the appended claims.

What is claimed is:

1. A submersible pumping system deployable in a wellbore to pump a fluid disposed in a subterranean formation, comprising:

an electric submersible pumping system having a motor and a pump powered by the motor;

a deployment system coupled to the electric submersible pumping system; and a power cable disposed along the deployment system and connected to the motor to provide power thereto, the power cable comprising at least three conductors that are individually protected by a mineral insulation layer and a metallic sheath layer.

2. The submersible pumping system as recited in claim 1, wherein the power cable is further comprised of an armor that extends about the at least three conductors collectively.

3. The submersible pumping system as recited in claim 2, wherein the armor comprises a metallic armor.

4. The submersible pumping system as recited in claim 1, wherein the metallic sheath layer is disposed radially outward of the mineral insulation layer.

5. The submersible pumping system as recited in claim 3, wherein the metallic sheath layer is disposed radially outward of the mineral insulation layer.

6. The submersible pumping system as recited in claim 5, wherein the at least three conductors are arranged in a generally flat configuration.

7. The submersible pumping system as recited in claim 5, wherein the at least three conductors are arranged in a generally triangular configuration.

8. The submersible pumping system as recited in claim 4, wherein the metallic sheath layer and the mineral insulation layer are disposed adjacent each other.

9. The submersible pumping system as recited in claim 1, further comprising a metallic connector attachable to the motor and capable of forming a metal-to-metal seal with the metallic sheath layer individually disposed about each conductor.

10. A power cable system for use in a subterranean environment, comprising:

a plurality of conductors;

a layer of insulation disposed about each conductor of the plurality of conductors;

a metallic sheath disposed about each conductor of the plurality of conductors;

an armor layer disposed about the plurality of conductors collectively; and a metallic connector adapted for connection to a submersible motor, wherein each metallic sheath is coupled to and sealed to the metallic connector via a metal-to-metal connection.

11. The power cable system as recited in claim 10, wherein the power cable is able to withstand temperatures in excess of approximately 600° Fahrenheit.

12. The power cable system as recited in claim 10, wherein the layer of insulation comprises a mineral insulation.

13. The power cable system as recited in claim 12, wherein the armor layer comprises a metal material.

14. The power cable system as recited in claim 13, wherein the power cable is able to withstand temperatures in excess of approximately 1,000° F.

15. The power cable system as recited in claim 13, wherein the plurality of conductors comprises at least three conductors.

16. The power cable system as recited in claim 13, wherein the plurality of conductors comprises copper.

17. A submersible system for use in a subterranean environment, comprising:

a power cable having:

a plurality of conductors capable of carrying three-phase power;

a layer of insulation disposed about each conductor of the plurality of conductors;

a metal sheath jacketed about each layer of insulation;

an armor disposed about the plurality of conductors; and a connector forming a metal-to-metal seal with the metal sheath about each conductor; and a submersible motor coupled to the connector.

18. The submersible system as recited in claim 17, wherein the layer of insulation comprises a mineral insulation.

19. The submersible system as recited in claim 17, further comprising an electric submersible pumping system comprising the submersible motor electrically coupled to the power cable.

20. The submersible system as recited in claim 19, further comprising a deployment system connected to the electric submersible pumping system.

21. The submersible system as recited in claim 18, wherein the armor comprises a metal material.

22. The submersible system as recited in claim 21, wherein the plurality of conductors is arranged in a flat profile.

* * * * *